United States Patent [19]

Shibata et al.

[11] Patent Number: 4,715,202

[45] Date of Patent: Dec. 29, 1987

[54] COIL-SPRING WINDING APPARATUS

[75] Inventors: Masaharu Shibata, Kamakura; Tsutomu Furuyama; Kazuo Ohkoshi, both of Yokohama, all of Japan

[73] Assignee: NHK Spring Co. Ltd., Yokohama, Japan

[21] Appl. No.: 37,865

[22] Filed: Apr. 13, 1987

[30] Foreign Application Priority Data

Apr. 22, 1986 [JP] Japan ..... 61-92816

[51] Int. Cl.[4] ..... B21F 3/04

[52] U.S. Cl. ..... 72/21; 72/143; 72/144

[58] Field of Search ..... 72/21, 22, 23, 24, 135, 72/138, 139, 142, 143, 144, 145

[56] References Cited

U.S. PATENT DOCUMENTS

| | | | |
|---|---|---|---|
| 2,094,204 | 9/1937 | Carter et al. | 72/142 |
| 2,165,411 | 7/1939 | Peyton | 72/142 |
| 3,423,980 | 1/1969 | Ludwig et al. | 72/142 |
| 3,470,721 | 10/1969 | Scheublein et al. | 72/144 |
| 3,610,006 | 10/1971 | Scheublein et al. | 72/138 X |
| 4,132,094 | 1/1979 | Missioux | 72/142 X |
| 4,444,036 | 4/1984 | Shibata et al. | 72/138 |

FOREIGN PATENT DOCUMENTS

| | | |
|---|---|---|
| 55-84226 | 6/1980 | Japan . |
| 56-20935 | 5/1981 | Japan . |
| 61-20641 | 1/1986 | Japan . |

*Primary Examiner*—E. Michael Combs

*Attorney, Agent, or Firm*—Frishauf, Holtz, Goodman & Woodward

[57] ABSTRACT

A coil-spring winding apparatus according to the present invention comprises a guide rail extending along the axis of a mandrel, and a carriage movably supported by the guide rail. The carriage is fitted with first and second guide rollers. The second guide roller, which is spaced from the first guide roller in the radial direction thereof, guides the coil forming a coil spring toward the first guide roller. The first guide roller is moved in the axial direction of the mandrel, at a speed determined by the rotating speed of the mandrel, so that the coil is wound at predetermined pitches. The second guide roller can pivot around a point near the point of contact between the first guide roller and the coil. The first guide roller is oriented always in the same direction as the second guide roller. The direction of these two guide rollers is changed by means of an actuator, depending on the pitch angle of the coil spring.

5 Claims, 14 Drawing Figures

COIL-SPRING WINDING APPARATUS

BACKGROUND OF THE INVENTION

The present invention relates to a coil-spring winding apparatus and, more particularly, to an improvement of means for guiding a coil spring on a mandrel.

A typical example of a conventional coil-spring winding apparatus comprises a mandrel and a lead screw extending parallel thereto. The lead screw is formed with a spiral groove which corresponds to the pitch and pitch angle of a coil spring. The mandrel and the lead screw are rotated in opposite directions. As the coil is guided onto the mandrel by the spiral groove, it is wound around the mandrel.

However, the designing and manufacture of the lead screw, in such a prior art apparatus, require much time and effort. Besides, the lead screw can be used for only one type of coil spring. Moreover, it is difficult to form a coil spring whose pitch angle changes drastically.

In a coil-spring winding apparatus disclosed in Japanese Patent Publication No. 20935/81, a guide roller is used in place of the lead screw. This winding apparatus comprises a mandrel and the guide roller spaced therefrom in the radial direction thereof. The guide roller is moved, by an actuator, in the axial direction of the mandrel, at a speed associated with the rotating speed of the mandrel. The coil is wound around the mandrel as it is guided by the guide roller.

Using the guide roller, the aforementioned winding apparatus does not require any large-sized, heavy member, such as the lead screw. Moreover, if the moving speed of the guide roller is continually changed, moreover, this apparatus can be applied to various types of coil spring. Since the mandrel and the guide roller are spaced widely apart, however, the coil cannot easily be guided to an accurate position on the mandrel. In forming a coil spring whose pitch angle varies considerably, the coil tends to slip on the mandrel, and therefore, cannot easily be wound at an accurate pitch angle.

In a winding apparatus stated in U.S. Pat. No. 3,610,006, the guide roller is located just over the mandrel. This prior art guide roller cannot, however, guide the coil in its first turn. In this winding apparatus, therefore, the coil is guided in its first turn by a guide finger which is provided independently of the guide roller and is located at a distance from the mandrel. Therefore, this conventional winding apparatus is disadvantageous in two respects. First, the guide finger requires precise and accurate control. Secondly, those turns of the spring, which forms the leading end thereof, are at a pitch differnt from the desired value.

SUMMARY OF THE INVENTION

Accordingly, an object of the present invention is to provide an apparatus capable of forming a coil spring with an accurate pitch and pitch angle. Another object of the invention is to provide an apparatus whereby even a coil spring with a drastically changing pitch angle can be formed into an accurate shape.

In order to achieve the above objects, according to the present invention, a coil-spring winding apparatus is provided which produces a coil spring by forming a heated rod-shaped material of the coil spring into a spiral. The winding apparatus comprises a mandrel having one end and an outer peripheral surface on which the coil is to be wound; first drive means, for rotating the mandrel, and including a motor; a chuck used for holding the leading end of the coil, the chuck being located on one end side of the mandrel and adapted to rotate together therewith; a guide rail extending parallel to the mandrel; a carriage supported by the guide rail, for reciprocation along the rail; second drive means, for moving the carriage, the second drive means including a first actuator, for moving the carriage at a speed determined by the rotating speed of the mandrel; a first holder, attached to the carriage so as to be movable in the radial direction of the mandrel; a first guide roller mounted on the first holder, the guide roller having an outer peripheral surface facing that of the mandrel, the peripheral surface having a groove thereon in which a part of the coil can be fitted; a second actuator, for moving the first guide roller together with the first holder, in the radial direction of the mandrel; a second guide roller, arranged at a radial distance from the first guide roller, and adapted to guide the coil toward the first guide roller; supporting means attached to the carriage and supporting the second guide roller, the supporting means including a second holder for mounting the second guide roller, whereby the second guide roller is supported such that the second guide roller can substantially face the point of contact between the first guide roller and the coil, and can pivot substantially around the contact point; and a third actuator, for reorienting the second guide roller in accordance with the pitch angle of the coil spring.

A heated material of the coil spring is guided to the mandrel via the second and first guide rollers. The leading end of the coil is fixed to the mandrel by the chuck. Before the mandrel rotates, the first guide roller is retreated to a position where it cannot engage the chuck. After the mandrel starts to rotate, the first guide roller is moved toward the coil, immediately when the chuck is moved to a position where it does not engage the first guide roller. In this way, the position of the coil is restricted by the first guide roller.

As the mandrel rotates, the carriage is moved in the axial direction of the mandrel, so that the first guide roller also moves in the same direction. The carriage moves at a speed determined by the rotating speed of the mandrel. The position of the coil on the mandrel, from its leading end to its trailing end, is regulated accurately by the first guide roller. Thus, the coil can be wound around the mandrel, with an accurate pitch.

At the point where the pitch angle of the coil spring changes, the second guide roller is reoriented relative to the mandrel. Accordingly, the coil is bent at an angle equivalent to the pitch angle, by the first and second guide rollers, before it is wound around the mandrel. Thus, even a coil spring with a drastically changing pitch angle can be wound accurately around the mandrel.

The completed coil spring, which is used, for example, as a car suspension spring, may be utilized for any other suitable applications.

DETAILED DESCRIPTION OF THE PREFERRED EMBODIMENTS

Figure 1:
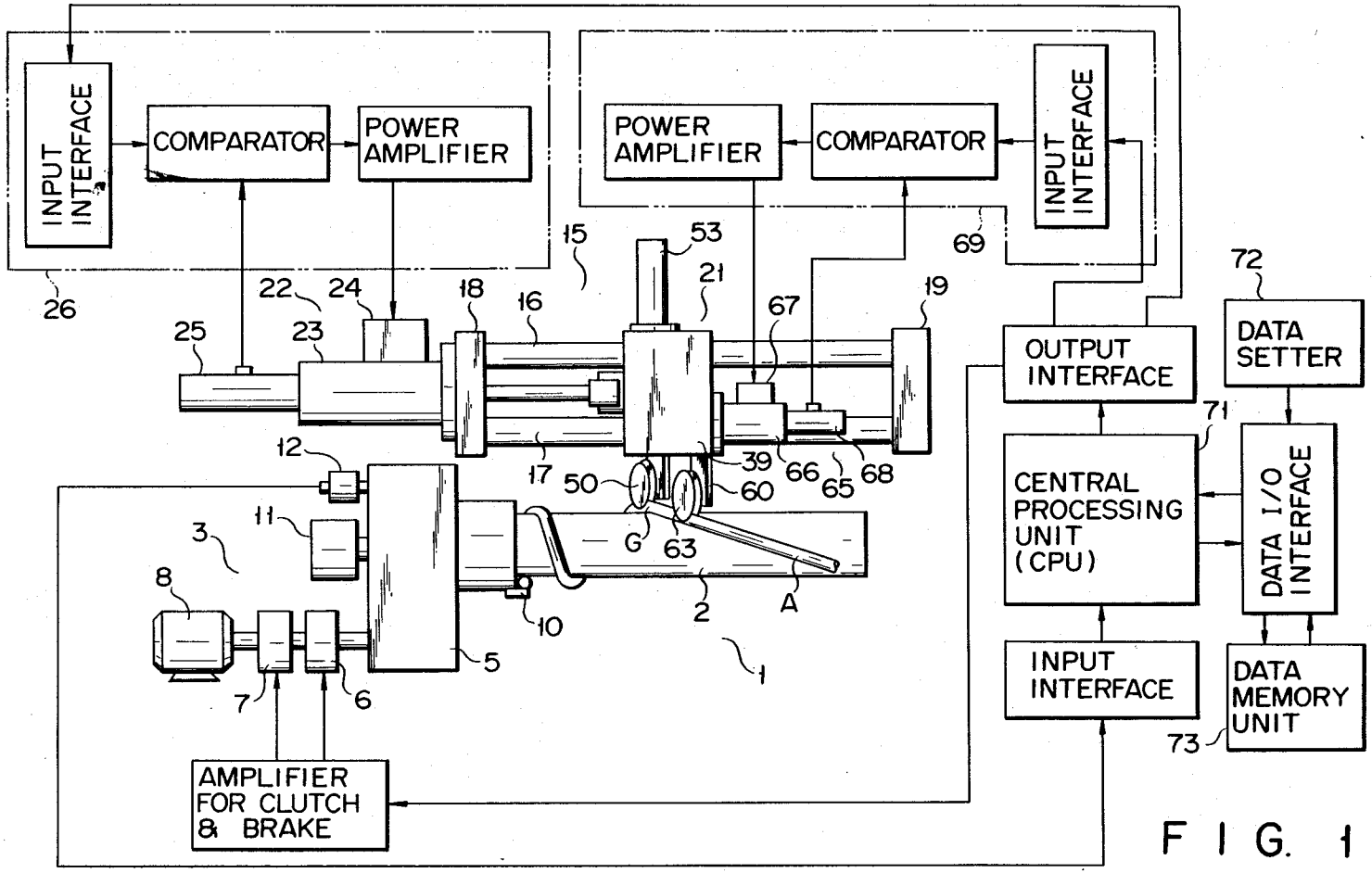
FIG. 1 is a front view of a coil-spring winding apparatus according to an embodiment of the present invention.

Referring now to FIG. 1, showing an embodiment of the present invention, mandrel 2 has an outer peripheral surface on which coil A of a coil spring is wound. Although mandrel 2 of this embodiment is columnar in shape, it may alternatively be conical or barrel-shaped, depending on the shape of the coil spring. In addition, the mandrel used may be composed of a plurality of separable sections.

Mandrel 2 is rotated by drive mechanism 3, which includes reduction gear system 5, brake 6, clutch 7, and motor 8.

Chuck 10 is attached to one end of mandrel 2, and is used to hold the leading end of coil A and fix it to mandrel 2. Chuck 10 is opened and closed by means of hydraulic cylinder mechanism 11. Reduction gear system 5 is provided with first sensor 12 for detecting the rotational angle of mandrel 2. A rotary encoder is used as the first sensor.

Guide unit 15 for guiding coil A will now be described in detail.

A pair of guide rails 16 and 17 are arranged parallel to mandrel 2. Opposite ends of each guide rail are fixed individually to base plates 18 and 19. Carriage 21 is mounted on rails 16 and 17, and can move along the guide rails, being driven by carriage-drive mechanism 22. A hydraulic cylinder mechanism is used as actuator 23 of mechanism 22. Actuator 23 is provided with servo valve 24 and second sensor 25 for detecting the position of carriage 21. Valve 24 is controlled by control circuit 26.

Figure 2:
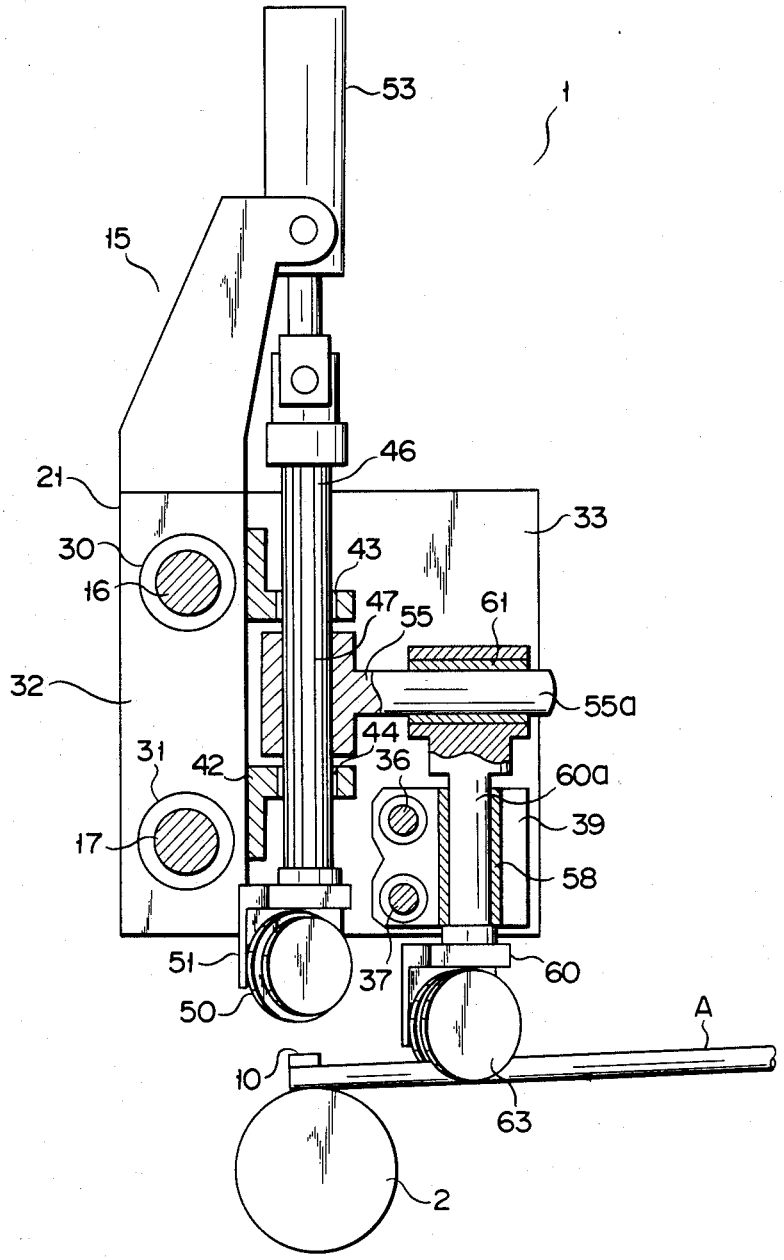
FIGS. 2 and 3 are side views, partially in section, showing the apparatus of FIG. 1 in different operating states.
Figure 3:
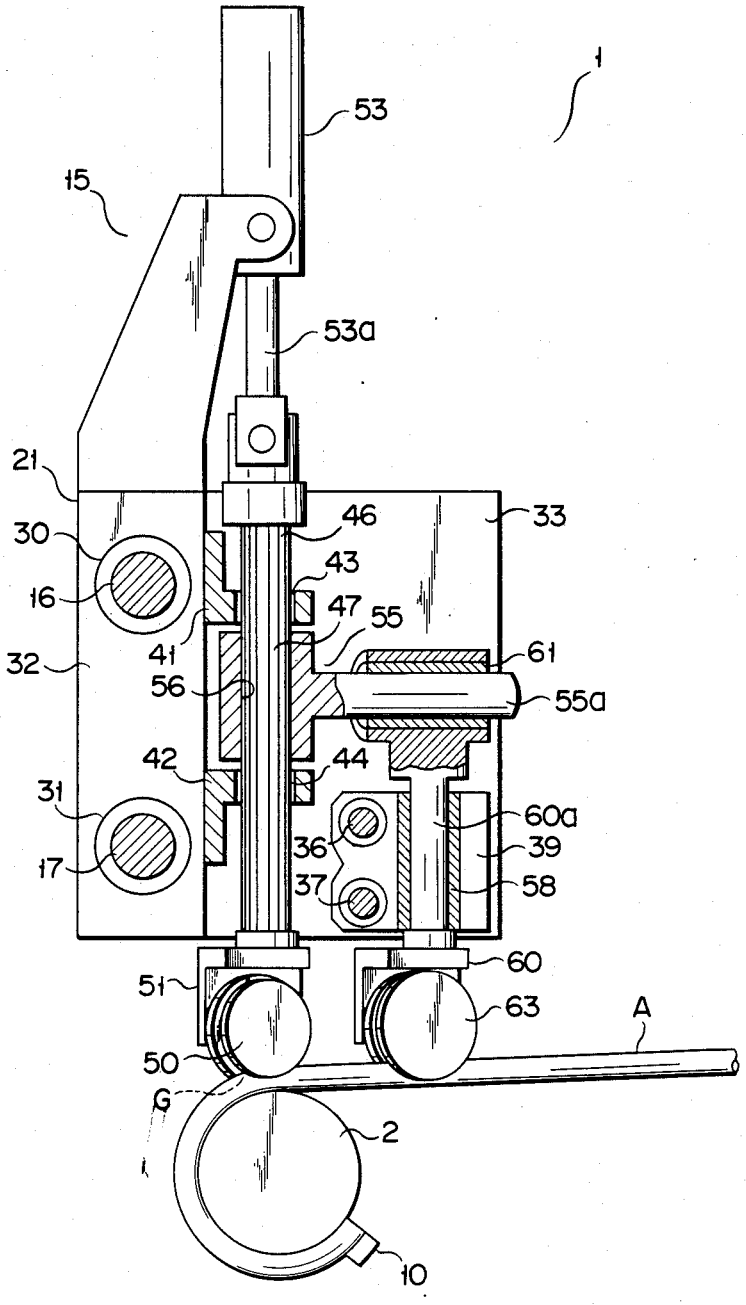
Figure 4:
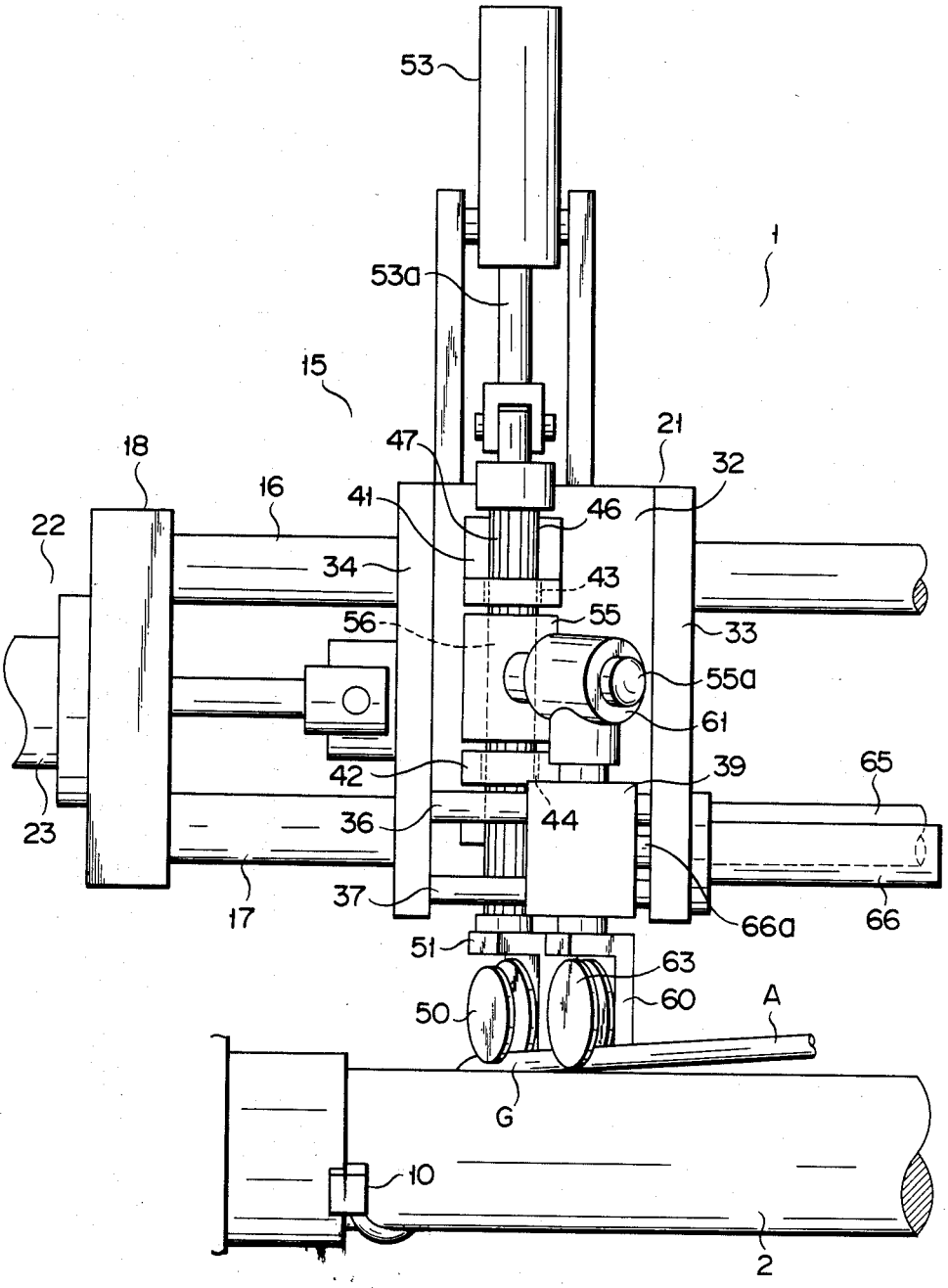
FIG. 4 is a partial front view of the apparatus shown in FIG. 1.

As is shown in FIGS. 2 to 4, carriage 21 includes base portion 32 having bearings 30 and 31, and side plates 33 and 34 on either side of base portion 32. A parallel pair of sub-guide rails 36 and 37 stretch between side plates 33 and 34. Rails 36 and 37 are fitted with slider 39, which is movable therealong.

A pair of brackets 41 and 42, having through holes 43 and 44, respectively, are attached to carriage 21 so as to be spaced vertically from each other. Sliding shaft 46 rotatably penetrates holes 43 and 44, and can reciprocate in its axial direction. Shaft 46 is formed with sliding key grooves or splines 47 extending along its axis.

Figure 5:
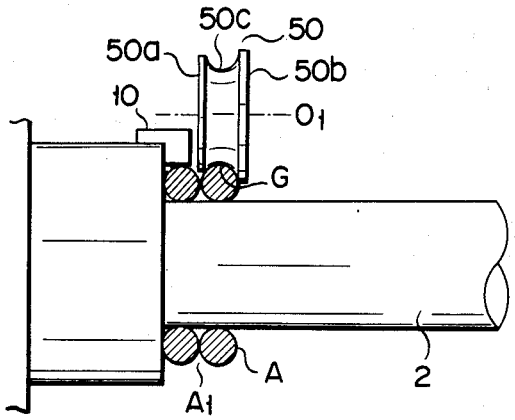
FIG. 5 is a front view illustrating a mandrel and a first guide roller shown in FIG. 1.
Figure 6:
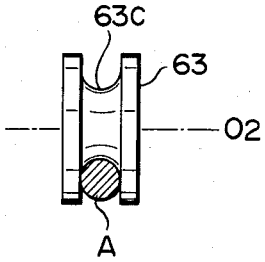
FIG. 6 is a front view of a second guide roller shown in FIG. 1.

First holder 51 is provided at the lower end of sliding shaft 46. Rotatable first guide roller 50 is attached to holder 51. As is shown in FIG. 5, first flange (chuck-side flange) 50*a* of roller 50 is made thinner than second flange 50*b*, so as to prevent it coming into contact with the first-turn portion of coil A wound around mandrel 2. Guide roller 50 is formed, on its outer peripheral surface, with groove 50*c* in which a part of coil A can be fitted.

Actuator 53, used to move sliding shaft 46 in its axial direction, is coupled to the upper end of shaft 46. A hydraulic cylinder mechanism having rod 53*a* is used as actuator 53.

Arm 55 is attached to the middle portion of sliding shaft 46, and has internal teeth 56 which are in mesh with splines 47 of shaft 46. Therefore, although sliding shaft 46 rotates together with arm 55, these two members can move relative to each other, in the vertical direction. Partially held between brackets 41 and 42, arm 55 cannot move vertically.

Slider 39 includes bearing 58 which has a hole parallel to sliding shaft 46. Second holder 60 is rotatably supported by bearing 58. Bearing 61 is attached to the upper end of support shaft 60*a* which extends upward from holder 60. Bearing 61 has a hole extending at right angles to shaft 60*a*. Horizontally extending portion 55*a* of arm 55 is inserted in the hole of bearing 61, to permit arm 55 to slide horizontally.

Figure 7:
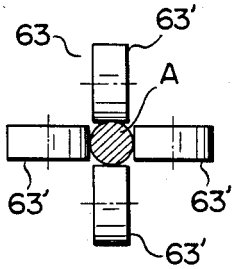
FIG. 7 is a front view showing a modification of the second guide roller.

Rotatable second guide roller 63 is attached to second holder 60. Coil A is guided toward first guide roller 50 by groove 63*c* of roller 63. Alternatively, roller 63 may be replaced with a plurality of rollers 63', as is shown in FIG. 7.

Figure 8:
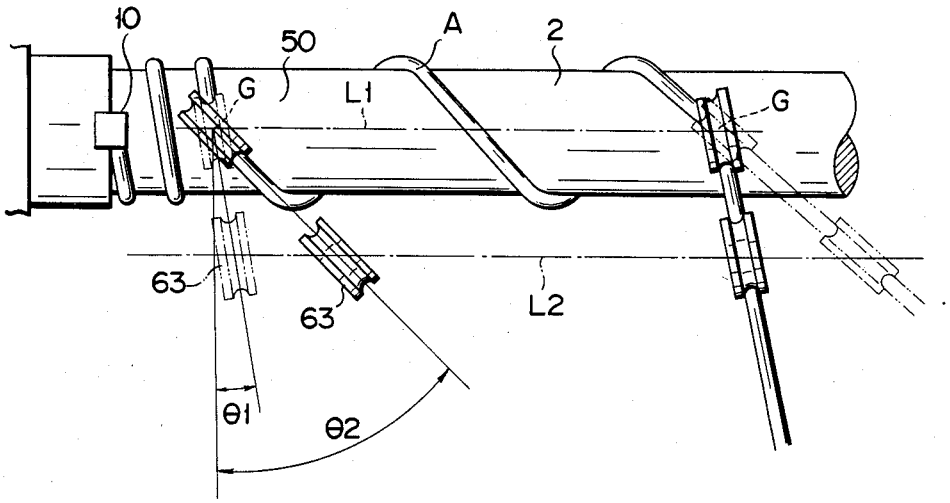
FIG. 8 is a plan view illustrating relationships between the mandrel and the guide rollers shown in FIG. 1.

Sliding shaft 46 rotates together with second holder 60, through the medium of arm 55. Therefore, when second guide roller 63 pivots horizontally around a point near the point of contact between first guide roller 50 and coil A, roller 50 is oriented in the same direction as roller 63. As is shown in FIG. 8, groove 50*c* of roller 50 is in alignment with groove 63*c* of roller 63.

Carriage 21 is provided with mechanism 65 for reorienting guide rollers 50 and 63. Mechanism 65 includes actuator 66 used to move slider 39. A hydraulic cylinder mechanism having rod 66*a* is used as actuator 66. Actuator 66 is provided with servo valve 67 and third sensor 68, for detecting the position of second guide roller 63. Valve 67 is controlled by control circuit 69. When slider 39 is moved along guide rails 36 and 37, first and second guide rollers 50 and 63 are reoriented simultaneously. The respective strokes of rollers 50 and 63 are parallel to mandrel 2, as is indicated by dashed lines L1 and L2, respectively, in FIG. 8.

Control circuits 26 and 69 are controlled by central processing unit (CPU) 71, which receives an output signal from first sensor 12. Data setter 72 and auxiliary data memory unit 73 are connected to CPU 71. Reference data on the shape of the coil spring is applied from setter 72 or memory unit 73 to the input of CPU 71. A magnetic tape or floppy disk is used as a recording medium for memory unit 73.

The operation of winding apparatus 1 with the aforementioned construction will now be described.

Figure 9:
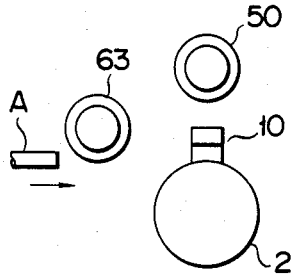
FIGS. 9 to 12 are side views showing the guide rollers and the mandrel in various operating states.
Figure 10:
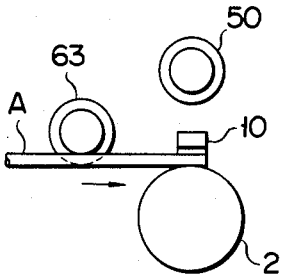
Figure 11:
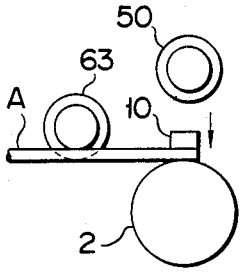

Material of coil spring is heated to a temperature of, for example, 950° C. to 980° C. by heating means (not shown), and is then supplied to second guide roller 63. At this time, chuck 10 is open, as is shown in FIG. 9. First guide roller 50 is pulled up, by actuator 53, to a position where it cannot engage chuck 10, as is shown in FIG. 2. When the leading end of coil A reaches chuck 10, as is shown in FIG. 10, the chuck is closed by cylinder mechanism 11. In this way, the end of coil A is fixed to mandrel 2, as is shown in FIG. 11.

Figure 12:
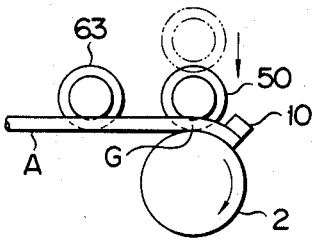

When clutch 7 is connected, the rotatory force of motor 8 is transmitted to mandrel 2 via reduction gear system 5. When chuck 10 is moved to a position where it cannot engage first guide roller 50, as mandrel 2 rotates, roller 50 is immediately lowered to the position of coil A by actuator 53, as is shown in FIG. 12. Since first and second guide rollers 50 and 63 are oriented always in the same direction, a part of coil A is fitted in groove 50c of roller 50 only when roller 50 is lowered in the aforesaid manner. As is shown in FIG. 5, moreover, chuck-side flange 50a of first guide roller 50 is thinner than second flange 50b, in order to prevent it from touching the turn wound around mandrel 2.

Thus, once coil A starts to be wound around mandrel 2, it is accurately guided to a desired position by first guide roller 50. In this manner, end portion A1 of the coil spring can be formed with high accuracy.

As mandrel 2 rotates, first sensor 12 generates a pulse corresponding to the rotational angle of the mandrel. This pulse is applied to the input of CPU 71. The CPU delivers output signals for controlling the operation of servo valve 24, 67, in accordance with the rotational angle of mandrel 2 and the previously input reference data on the coil spring.

When carriage 21 is moved by actuator 23, first and second guide rollers 50 and 63 move together in the axial direction of mandrel 2. Thereupon, coil A is wound around mandrel 2, while being guided thereon by guide rollers 50 and 63, in accordance with the pitch of the coil spring. The moving speed of carriage 21 is determined by the rotating speed of mandrel 2.

At the point where the pitch angle of the coil spring changes, second guide roller 63 is reoriented by actuator 66. At the point where the pitch angle changes from $\theta 1$ to $\theta 2$, for example, the tilt angle of roller 63 varies from $\theta 1$ to $\theta 2$. Second guide roller 63 pivots around a point near contact point G between first guide roller 50 and coil A. When the direction or tilt angle of roller 63 changes, roller 50 is reoriented in the same direction as roller 63.

The time required for changing the tilt angle of guide rollers 50 and 63 depends on the responsiveness of actuator 66. The operating time of the hydraulic cylinder mechanism, for use as actuator 66, is very short, ranging from about 0.05 to 0.08 of a second. Thus, actuator 66 can satisfactorily respond to even a drastic change in the pitch angle of coil A.

Figure 14:
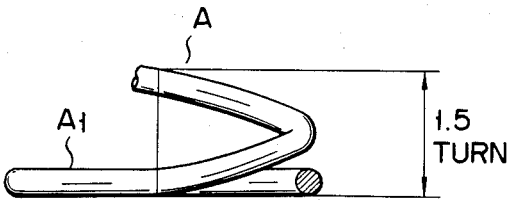
FIG. 14 is a side view showing an end portion of a coil spring.
Figure 13:
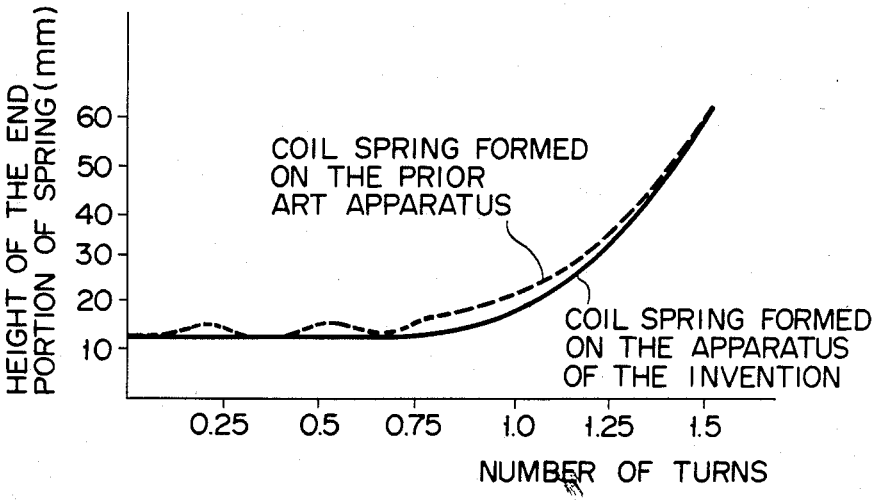
FIG. 13 is a diagram illustrating relationships between the height of a coil and the number of turns of the coil as counted from its end.

Coil A is guided on mandrel 2 by first guide roller 50, until its trailing end is reached. Accordingly, even the trailing end portion of the coil spring can be formed with high accuracy. FIG. 13 shows the difference in shape between the end portion of a coil spring formed by means of a prior art winding apparatus, which has only one guide roller, and that of a coil spring formed by means of apparatus 1 of the present invention. The object of the comparison is limited to a portion corresponding to about 1.5 turns of the coil-spring, as is shown in FIG. 14. The end portion of the coil spring formed on the prior art apparatus is wound irregularly, as is indicated by a broken line in FIG. 13. In contrast with this, the end portion of the coil spring formed on apparatus 1 of the invention has an accurate shape and is free from irregularities, as is indicated by a full line in FIG. 13.

What is claimed is:

1. A coil-spring winding apparatus for manufacturing a coil spring by forming a heated rod-shaped material into a spiral, comprising:

a mandrel having one end and an outer peripheral surface on which the coil is to be wound;

first drive means, for rotating the mandrel, said drive means including a motor;

a chuck used for holding a leading end of the coil, said chuck being located at one end of the mandrel and adapted to rotate together therewith;

a guide rail extending parallel to the mandrel;

a carriage supported by the guide rail, for reciprocation along the rail;

second drive means, for moving the carriage, said second drive means including a first actuator, for moving the carriage at a speed determined by the rotating speed of the mandrel;

a first holder, attached to the carriage so as to be movable in the radial direction of the mandrel;

a first guide roller mounted on the first holder, said guide roller having an outer peripheral surface facing that of the mandrel, said peripheral surface having a groove thereon in which a part of the coil can be fitted;

a second actuator, for moving the first guide roller together with the first holder, in the radial direction of the mandrel;

a second guide roller, arranged at a radial distance from the first guide roller, and adapted to guide the coil toward the first guide roller;

supporting means attached to the carriage and supporting the second guide roller, said supporting means including a second holder for mounting the second guide roller, wherein the second guide roller is supported such that the second guide roller substantially faces a point of contact between the first guide roller and the coil, and is pivotable substantially around the contact point; and a third actuator, for reorienting the second guide roller in accordance with the pitch angle of the coil spring.

2. The coil-spring winding apparatus according to claim 1, wherein said means for supporting the second guide roller includes an arm for coupling the first and second holders so that the first guide roller is oriented in the same direction as the second guide roller when the second guide roller is reoriented.

3. The coil-spring winding apparatus according to claim 1, further comprising:

a first sensor, for detecting the rotational angle of the mandrel;

a second sensor, for detecting the position to which the carriage has moved;

a third sensor, for detecting the position of the second guide roller relative to the carriage; and a CPU delivering command signals for controlling the first and third actuators, said CPU being supplied previously with reference data on the pitch and pitch angle of the coil spring, and adapted to be supplied with a signal, indicative of the rotational angle of the mandrel, from the first sensor, so that the CPU controls the first and third actuators in accordance with the reference data and the rotational-angle signal.

4. The coil-spring winding apparatus according to claim 1, wherein said second actuator is composed of a first hydraulic cylinder mechanism having a rod, and said third actuator is composed of a second hydraulic cylinder mechanism having a rod, wherein said carriage has a rotatable sliding shaft capable of ascending and descending in the radial direction of the mandrel, said sliding shaft having an upper end coupled with the rod of the first hydraulic cylinder mechanism, and a lower end fitted with the first holder, and wherein said supporting means for the second guide roller includes a horizontal arm attached to the sliding shaft so as to be rotatable together therewith, a sub-guide rail attached to the carriage so as to extend parallel to the guide rail, a slider slidably supported by the sub-guide rail and coupled to the rod of the second hydraulic cylinder mechanism, and a second holder having upper and lower ends and rotatably supported by the slider, said arm being fitted in the upper end of the second holder, to permit said arm to slide horizontally.

5. The coil-spring winding apparatus according to claim 1, wherein said first guide roller has a pair of flanges, one of said flanges, which is situated on the side of the chuck, being thinner than the other flange.

* * * * *